US012185771B2

(12) United States Patent
Kikuchi

(10) Patent No.: US 12,185,771 B2
(45) Date of Patent: Jan. 7, 2025

(54) PANTS

(71) Applicant: Kouya Kikuchi, Iwate (JP)

(72) Inventor: Kouya Kikuchi, Iwate (JP)

(73) Assignee: Kouya Kikuchi (JP)

( * ) Notice: Subject to any disclaimer, the term of this patent is extended or adjusted under 35 U.S.C. 154(b) by 0 days.

(21) Appl. No.: 18/275,654

(22) PCT Filed: Jul. 9, 2021

(86) PCT No.: PCT/JP2021/026005
§ 371 (c)(1),
(2) Date: Aug. 3, 2023

(87) PCT Pub. No.: WO2022/168345
PCT Pub. Date: Aug. 11, 2022

(65) Prior Publication Data
US 2024/0292912 A1 Sep. 5, 2024

(51) Int. Cl.
*A41D 13/12* (2006.01)
*A41D 1/06* (2006.01)
*A41F 1/00* (2006.01)

(52) U.S. Cl.
CPC . *A41D 1/06* (2013.01); *A41F 1/00* (2013.01)

(58) Field of Classification Search
CPC ..... A41D 1/06; A41F 1/00
See application file for complete search history.

(56) References Cited

U.S. PATENT DOCUMENTS 3,324,856 A * 6/1967 Young ..... A61F 5/449 604/397
5,643,236 A * 7/1997 Hadley ..... A61F 5/4408 604/327
6,132,408 A * 10/2000 Lutz ..... A61F 5/4407 604/335
7,181,773 B1 * 2/2007 Piraka ..... A41D 13/1281 2/114

(Continued)

FOREIGN PATENT DOCUMENTS

JP 30 99 322 U 4/2004
JP 2007-119937 A 5/2007
JP 2018-16915 A 2/2018

*Primary Examiner* — Robert H Muromoto, Jr.
(74) *Attorney, Agent, or Firm* — SCHROEDER INTELLECTUAL PROPERTY LAW GROUP, LLC

(57) ABSTRACT

Pants having a large portion around a waist, but having slimmed-down portions of a crotch and around legs. The pants include a right front-body component, a left front-body component, a right back-body component, and a left back-body component. When, in the right front-body component and in the left front-body component, a line which is in parallel with a waist line of the right front-body component and that of the left front-body component, and which passes through a position where a rise portion has a minimum width is defined as a minimum width line, a position of the minimum width line in the vertical direction is formed within a range that is equal to or greater than 3 cm but equal to or smaller than 27 cm from the waist line, and a width of the waist line is formed so as to be larger than the minimum width within a range that is equal to or greater than 1 cm but equal to or smaller than 7 cm therefrom.

4 Claims, 7 Drawing Sheets

(56) References Cited

U.S. PATENT DOCUMENTS

| | | | | |
|---|---|---|---|---|
| 7,749,205 | B2 * | 7/2010 | Tazoe | A61F 5/451 604/320 |
| 11,766,081 | B2 * | 9/2023 | Thomas | A41D 13/1254 2/69 |
| 2006/0037124 | A1 * | 2/2006 | Cho | A41D 13/1245 2/114 |
| 2016/0050995 | A1 * | 2/2016 | Bentley | A41D 27/207 2/114 |
| 2017/0367872 | A1 * | 12/2017 | Cantrell | A61F 5/449 |

* cited by examiner

Prior Art

Prior Art

PANTS

RELATED APPLICATIONS

The present application is a § 371 national phase application of International Patent Application No. PCT/JP2021/026005 filed Jul. 9, 2021, which claims the filing benefit of International Patent Application No. PCT/JP2021/004454, filed Feb. 5, 2021—the contents of both of which are incorporated herein by reference.

TECHNICAL FIELD

The present disclosure relates to pants.

BACKGROUND ART

As illustrated in FIG. 4, general pants mainly include four parts that are a right front-body component 1X, a left front-body component 2X, a right back-body component 3X and a left back-body component 4X. These body components are sewn together, and thus pants 10X as illustrated in FIG. 7 and FIG. 10 are formed.

As illustrated in part (a) of FIG. 4, a right front-body component 1X is a part at the right side and at the front side relative to the median line of a person who wears the pants 10X. A median line side 1*a* of the right front-body component 1X includes a rise portion which extends linearly from a waist line A and which gradually becomes widespread across a crotch line C. Moreover, provided at the lower side of the rise portion is an inseam portion which gradually narrows down from the crotch line C toward a thigh portion, and which also extends linearly as appropriate in accordance with applications, such as long pants and short pants. Furthermore, a side surface side 1*b* of the right front-body component 1X is formed so as to draw a curve that expands outwardly from the waist line A to the crotch line C, and then to be linearly formed toward a foot side.

Moreover, as illustrated in part (b) of FIG. 4, the left front-body component 2X is formed so as to be substantially line symmetric to the right front-body component 1X, and is a part at the left side and at the front side relative to the median line of a person who wears the pants 10X. A median line side 2*a* of the left front-body component 2X includes a rise portion which extends linearly from the waist line A, and which gradually becomes widespread across the crotch line C. Furthermore, provided at the lower side of the rise portion is an inseam portion which gradually narrows down from the crotch line C toward the thigh portion, and which extends linearly as appropriate in accordance with applications, such as long pants and short pants. Still further, a side surface side 2*b* of the left front-body component 2X is formed so as to draw a curve that expands outwardly from the waist line A to the crotch line C, and then to be linearly formed toward a foot side.

Furthermore, as illustrated in part (c) of FIG. 4, the right back-body component 3X is a part at the back side and at the right side relative to the median line of the person who wears the pants 10X. A back median line side 3*a* of the right back-body component 3X includes a rise portion that extends in a curved shape from the waist line A to the crotch line C, and an inseam portion which gradually narrows down toward a thigh portion from the crotch line C, and which extends linearly as appropriate in accordance with applications, such as long pants and short pants. Moreover, a side surface side 3*b* of the right back-body component 3X is formed so as to draw a curve that expands outwardly from the waist line A to the crotch line C, and then to be linearly formed toward a foot side.

Still further, as illustrated in part (d) of FIG. 4, the left back-body component 4X is formed so as to be substantially line symmetric to the right back-body component 3X, and is a part at the back side and at the left side relative to the median line of the person who wears the pants 10X. A back median line side 4*a* of the left back-body component 4X includes a rise portion that extends in a curved shape from the waist line A to the crotch line C, and an inseam portion which gradually narrows down toward the thigh portion from the crotch line C, and which extends linearly as appropriate in accordance with applications, such as long pants and short pants. Moreover, a side surface side 4*b* of the left back-body component 4X is formed so as to draw a curve that expands outwardly from the waist line A to the crotch line C, and then to be linearly formed toward a foot side.

Meanwhile, in order to obtain an egest passage for stool and urine after a focus of disease originating from digestive diseases, urological diseases, etc., is eliminated, there is a person (an ostomate) who has a stoma 8 that is an open hole established by artificially guiding the digestive canal and the urinary passage to the exterior of the human body. As illustrated in FIG. 1 and in FIG. 2, stoma prosthetics 7 in a bag shape are attached to the stoma 8 so as to obtain an artificial egestion function. Moreover, as illustrated in FIG. 3, when excrement 9 is accumulated in the stoma prosthetics 7, an egestion opening 71 of the stoma prosthetics 7 is opened, and the excrement 9 is disposed to a toilet bowl, etc.

A person with such stoma prosthetics 7 needs to wear pants with a size that is made large by what corresponds to the stoma prosthetics 7. In such a case, according to conventional pants, when the size becomes large, as illustrated in FIG. 5 and FIG. 8, the respective lateral widths of the right front-body component 1Y, the left front-body component 2Y, the right back-body component 3Y and the left back-body component 4Y increase uniformly. Consequently, not only the portions around the waist where the stoma prosthetics 7 are stored but also the crotch portion and the portions around the legs become large, and thus there is a problem such as unshapeliness. Moreover, since the portions around the legs are large, there is a problem such that those portions disrupt walking.

Moreover, pants for a stoma which has a pocket to store the stoma prosthetics 7 have been also proposed. (e.g., Patent Document 1)

CITATION LIST

Patent Literatures

Patent Document 1: Registered Utility Model No. 3189145

SUMMARY OF INVENTION

Technical Problem

However, since such pants are different from general pants, there are problems such that processes in the production increase, and the number of components increases.

Hence, an objective of the present disclosure is to provide pants which can be produced by similar schemes to conventional schemes, has a large portion around a waist that is an attaching portion for stoma prosthetics 7, but has slimmed-down portions of a crotch and around legs.

Solution to Problem

In order to accomplish the above objective, pants according to the present disclosure includes:

a right front-body component;

a left front-body component;

a right back-body component; and a left back-body component, the pants being capable of storing therein stoma prosthetics, in which, when, in the right front-body component and in the left front-body component, a line which is in parallel with a waist line of the right front-body component and a waist line of the left front-body component, and which passes through a position where a rise portion has a minimum width is defined as a minimum width line;

a position of the minimum width line in a vertical direction is formed within a range that is equal to or greater than 3 cm but equal to or smaller than 27 cm from the waist line; and a width of the waist line is formed so as to be larger than the minimum width within a range that is equal to or greater than 1 cm but equal to or smaller than 7 cm therefrom.

It is preferable that an upper portion of the right front-body component and an upper portion of the left front-body component should have respective median line sides formed so as to be higher than respective side surface sides thereof.

The pants of the present disclosure may further include a suspender portion.

Advantageous Effects of Invention

According to the pants of the present disclosure, although a portion around a waist which is an attaching portion for the stoma prosthetics 7 is large, a crotch portion and portions around legs are slim. Hence, a user can enjoy dress-up as usual. Moreover, since the portions around legs are slim, facilitating walking.

DESCRIPTION OF EMBODIMENTS

Figure 1:
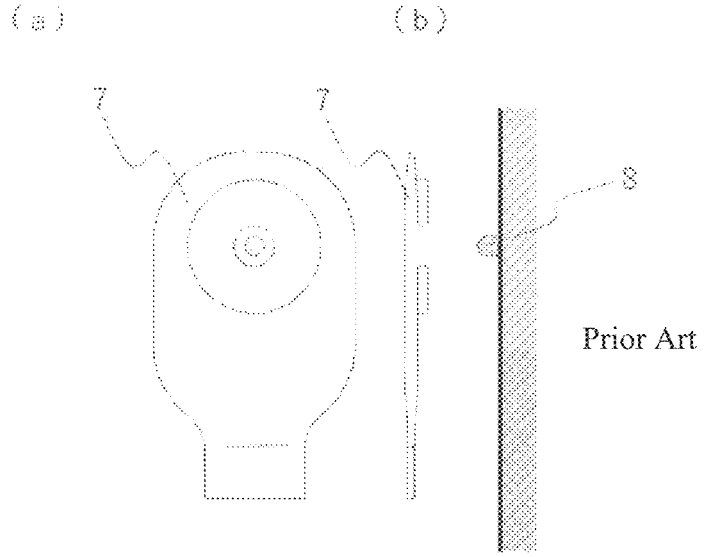
FIG. 1 is a front view (part (a)) and a schematic cross-sectional view (part (b)) which describe stoma prosthetics.
Figure 2:
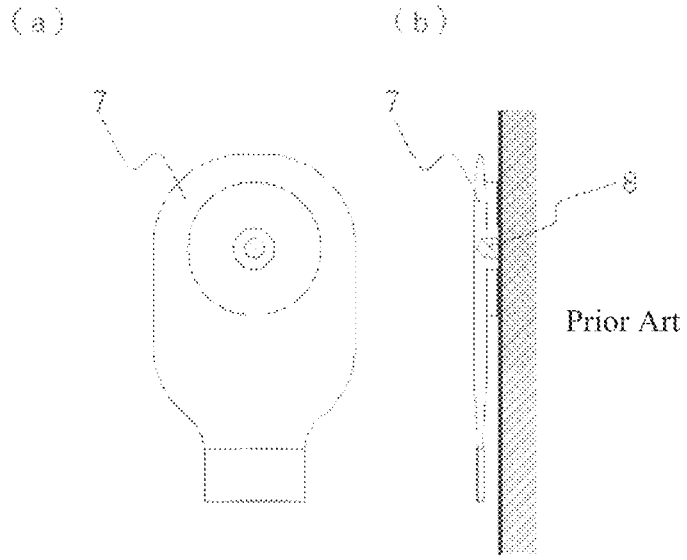
FIG. 2 is a front view (part (a)) and a schematic cross-sectional view (part (b)) which describe the stoma prosthetics.
Figure 3:
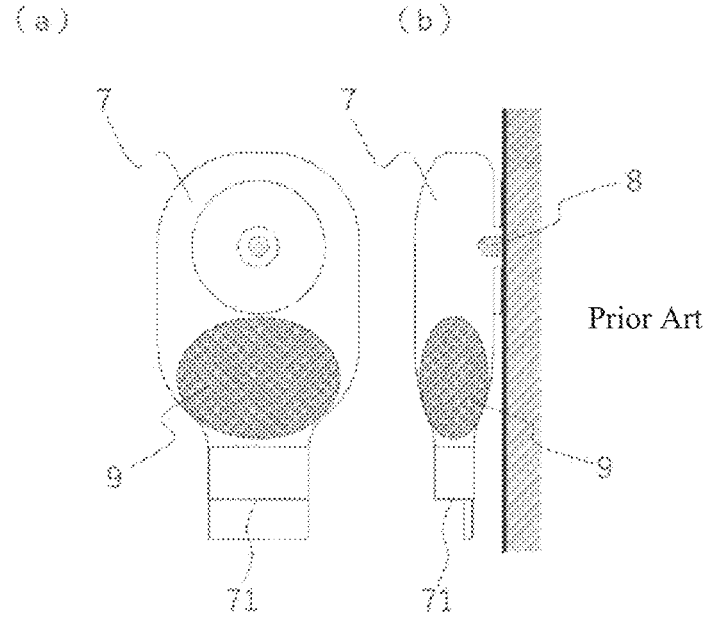
FIG. 3 is a front view (part (a)) and a schematic cross-sectional view (part (b)) which describe the stoma prosthetics.
Figure 4:
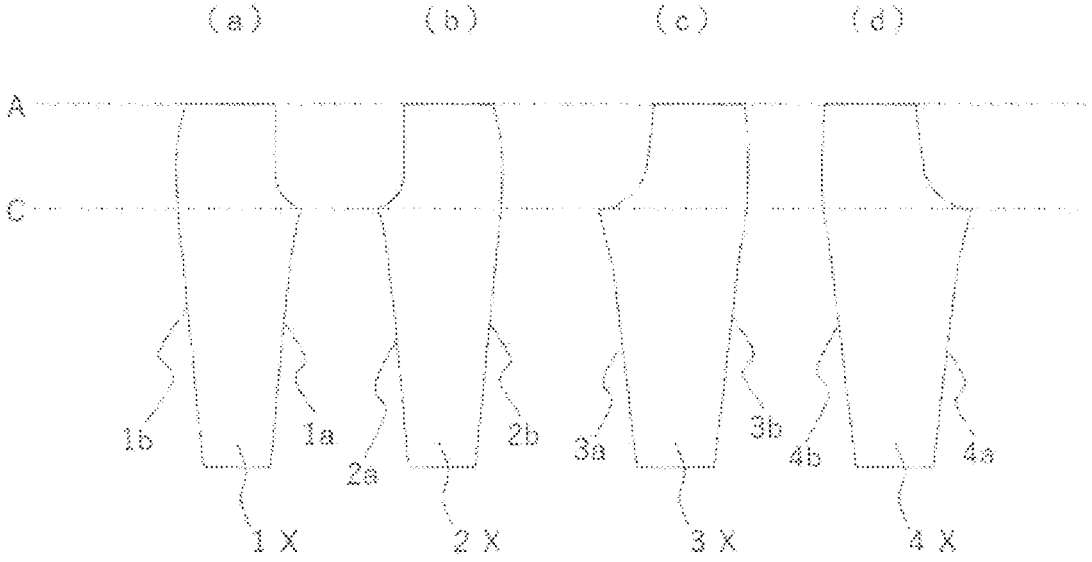
Prior Art FIG. 4
FIG. 4 is a schematic diagram of a body component of pants to be worn by a healthy person.
Figure 5:
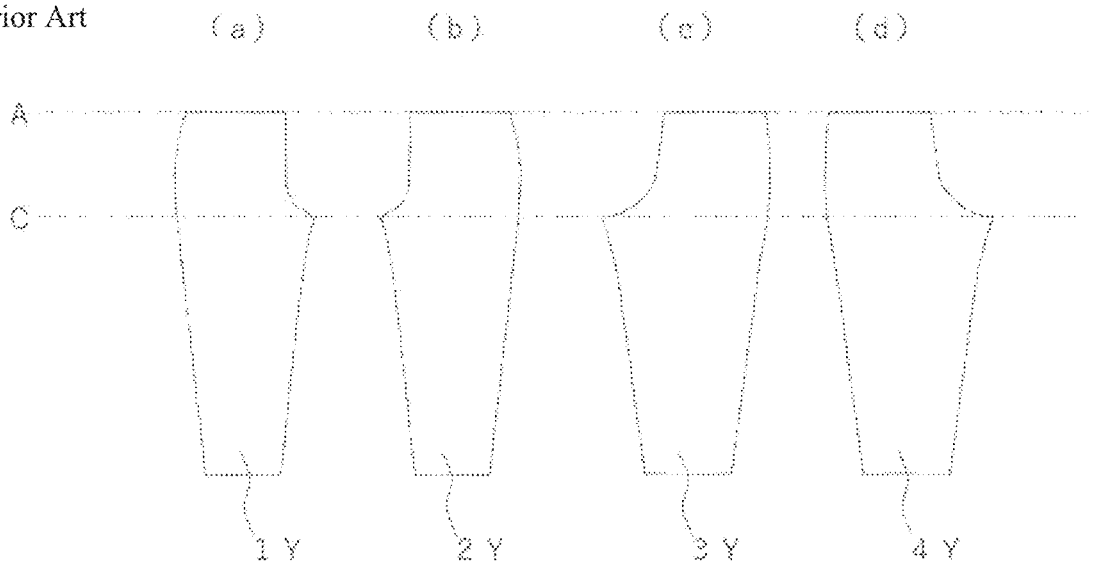
FIG. 5 Prior Art
FIG. 5 is a schematic diagram of a body component of conventional pants to be worn by a person with stoma prosthetics.
Figure 6:
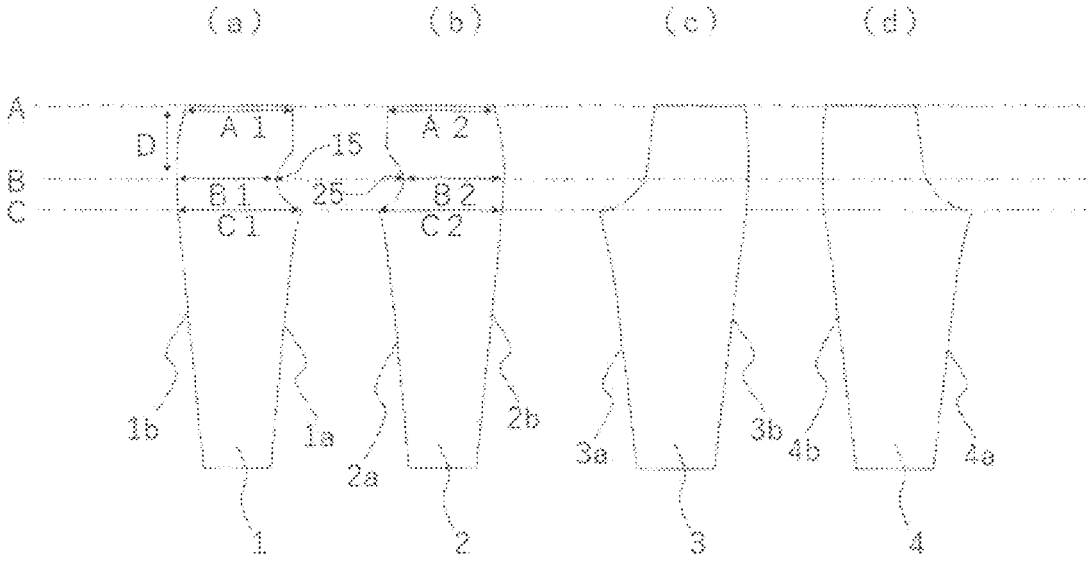
FIG. 6 is a schematic diagram of a body component of pants according to the present disclosure.
Figure 7:
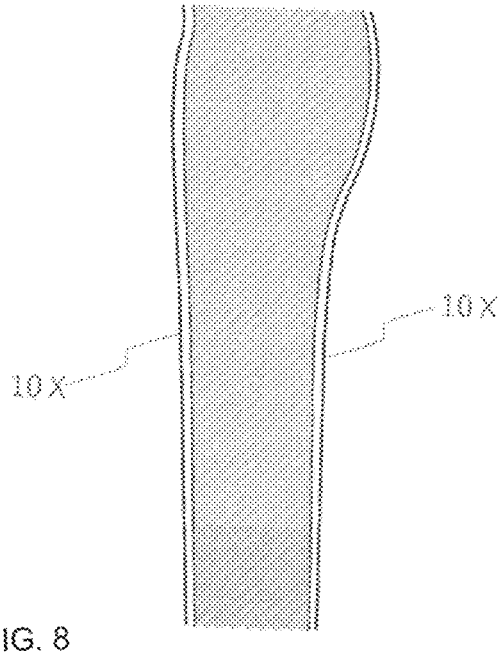
FIG. 7 is a schematic cross-sectional view of pants to be worn by a healthy person.
Figure 8:
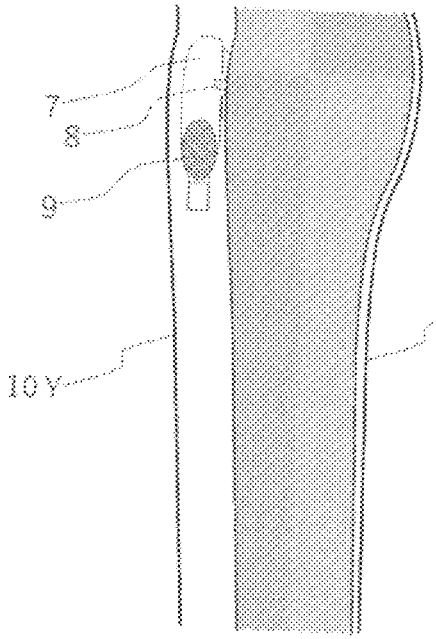
FIG. 8 is a schematic cross-sectional view of conventional pants to be worn by a person with stoma prosthetics.

As illustrated in FIG. 6, pants 10 according to the present disclosure includes a right front-body component 1, a left front-body component 2, a right back-body component 3, and a left back-body component 4. Note that the body components are parts to be sewn together when the pants 10 are formed.

In this specification, the term rise portion means a portion of the pants 10 from a waist line A to a crotch line C. Moreover, the term inseam portion means a part of the pants 10 below the crotch line C, i.e., a portion other than the rise portion of the pants 10. Furthermore, the term waist line A means a horizontal line that passes through the waist portion of the pants 10 or the uppermost portion of the pants 10 when the pants 10 is worn. Still further, a term minimum width line B is a line which is in parallel with the waist line A and the crotch line C, and which passes through the position on the rise portion where the width becomes the minimum. The position of such a minimum width line B is basically formed so as to be the position of the lower end of the attached stoma prosthetics 7 or the position where the excrement 9 within stoma prosthetics 7 is held. Yet still further, the term crotch line C means a horizontal line passing through the crotch portion of the pants 10. Moreover, the term width means the width of the body component in the horizontal direction (the perpendicular direction to the lengthwise direction of pants 10).

As illustrated in part (a) of FIG. 6, the right front-body component 1 means the part at the right side and at the front side relative to the median line of the person wearing the pants 10. The waist line A of the right front-body component 1 is formed so as to be long in the median line direction in such a way that a width A1 of the waist line A becomes larger than a minimum width B1 of the rise portion. In other words, a median line side 1*a* of the right front-body component 1 includes, at the rise portion, a concaved portion 15 where the width is narrower than the waist line A and the crotch line C. As a specific example, the rise portion is provided which extends in a curved shape from the waist line A, gradually narrows down, and then gradually becomes widespread across the crotch line C. Moreover, provided below the rise portion is the inseam portion which gradually narrows down from the crotch line C toward the thigh side, and which then extends linearly as appropriate in accordance with the applications, such as long pants or short pants. Furthermore, a side surface side 1*b* of the right front-body component 1 draws a curve from the waist line A to the crotch line C, and is formed in a linear shape toward a foot side.

As illustrated in part (b) of FIG. 6, the left front-body component 2 is formed so as to be substantially line symmetric to the right front-body component 1, and means a part at the left side and at the front side relative to the median line of the person wearing the pants 10. The waist line A of left front-body component 2 is formed so as to be long in the median line direction in such a way that a width A2 of the waist line A becomes larger than a minimum width B2 of the rise portion like the right front-body component 1. In other words, a median line side 2*a* of the left front-body component 2 includes, at the rise portion, a concaved portion 25 where the width is narrower than the waist line A and the crotch line C like the right front-body component 1. As a specific example, there is provided the rise portion which extends in a curved shape from the waist line A, gradually narrows down, and then gradually becomes widespread across the crotch line C. Moreover, provided below the rise portion is the inseam portion which gradually narrows down from the crotch line C toward the thigh side, and which then extends linearly as appropriate in accordance with the applications, such as long pants or short pants. Furthermore, a side surface side 2*b* of the left front-body component 2 draws a curve from the waist line A to the crotch line C, and is formed in a linear shape toward the foot side.

As illustrated in part (c) of FIG. 6, the right back-body component 3 means a part at the right side and at the back side relative to the median line of the person wearing the pants 10. A back median line side 3*a* of the right back-body component 3 includes a rise portion that extends in a curved shape from, for example, the waist line A to the crotch line C, and an inseam portion which gradually narrows down from the crotch line C toward the thigh side, and then extends linearly as appropriate in accordance with the applications, such as long pants or short pants. Moreover, a side surface side 3*b* of the right back-body component 3 draws a curve from, for example, the waist line A to the crotch line C and is then formed in a linear shape toward the foot side.

As illustrated in part (d) of FIG. 6, the left back-body component 4 is formed so as to be substantially line symmetric to the right back-body component 3, and means a part at the left side and at the back side relative to the median line of the person wearing the pants 10. A back median line side 4*a* of the left back-body component 4 includes a rise portion that extends in a curved shape from, for example, the waist line A to the crotch line C, and an inseam portion which gradually narrows down from the crotch line C toward the thigh side, and which then extends linearly as appropriate in accordance with the applications, such as long pants or short pants. Moreover, a side surface side 4*b* of the left back-body component 4 draws a curve from, for example, the waist line A to the crotch line C, and is then formed linearly toward the foot side.

The material applied to each body component is not limited to any particular one, but a clothing fabric that is known generally may be applied in accordance with a use purpose.

Regarding the respective rise portions of the right front-body component 1 and of the left front-body component 2, when respective widths of the rise portions on the waist line A are defined as A1 and A2, respective minimum widths on the minimum width line B are defined as B1 and B2, and respective widths of the rise portions on the crotch line C are defined as C1 and C2, B1 is formed so as to be smaller than A1 and C1 (i.e., A1>B1 and C1>B1), and B2 is formed so as to be smaller than A2 and C2 (i.e., A2>B2 and C2>B2). Note that, either one of A1 and C1, and either one of A2 and C2 may be larger, or may be the same.

Meanwhile, there are various sizes of stoma prosthetics 7, but in a case in which, for example, no excrement 9, such as stool or urine, is in such prosthetics, a height is 20 to 30 cm or so, and a width is 10 to 15 cm or so. The thickness of the stoma prosthetics 7 is 1 mm or so when nothing is therein, but the thickness increases up to 5 cm or so at the maximum when the excrement 9 is therein.

Hence, the waist line A of the right front-body component 1 and that of the left front-body component 2 are formed to be larger than the minimum width of the minimum width line B by what corresponds to the stoma prosthetics 7 in which the excrement 9 is present. More specifically, widths A1 and A2 of the waist line A should be larger than the minimum widths B1 and B2 of the minimum width line B by equal to or greater than 1 cm, and preferably, larger by equal to or greater than 2.5 cm.

Moreover, when the widths A1 and A2 of the waist line A are too large in comparison with the dimension of the stoma prosthetics 7, it may become difficult for a user to wear the pants 10, and may become unshapely. Hence, the widths A1 and A2 of the waist line A should be larger than the minimum widths B1 and B2 of the minimum width line B by equal to or smaller than 7 cm, preferably, by equal to or smaller than 5 cm, and more preferably, by equal to or smaller than 3 cm.

Furthermore, the positions of the concaved portions 15 and 25 or that of the minimum width line B in the vertical direction (the position in the perpendicular direction when the pants 10 is worn) are formed at sites where the stoma prosthetics 7 in which the excrement 9 is retained can be held. In general, when the excrement 9 is retained in the stoma prosthetics 7 by 3 cm or so, it is recommended to dispose in a toilet bowl, etc. Hence, a distance D between the minimum width line B and the waist line A is formed to be at least equal to or greater than 3 cm, preferably, equal to or greater than 5 cm, and more preferably, equal to or greater than 10 cm. Moreover, when it is desirable to store the stoma prosthetics 7 so as to be hidden within the pants, the distance D between the minimum width line B and the waist line A may be formed so as to be equal to or greater than 20 cm.

Conversely, when the minimum width line B and the waist line A are too apart from each other, it becomes unstable to hold the stoma prosthetics 7, and the crotch portion becomes too large, which is unshapely. Hence, the distance D between the minimum width line B and the waist line A should be formed so as to be equal to or shorter than 27 cm, preferably, equal to or shorter than 25 cm, and more preferably, equal to or shorter than 23 cm.

Figure 9:
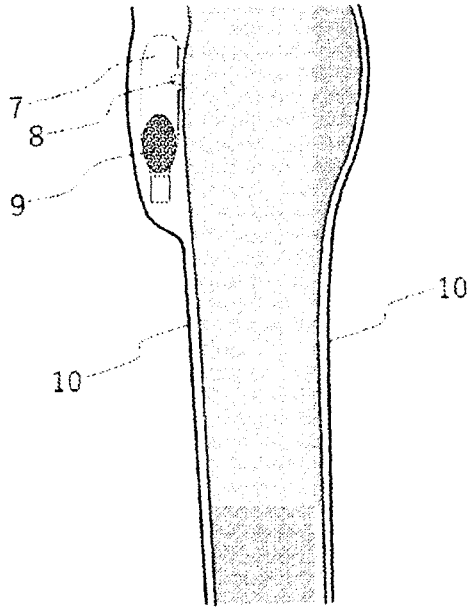
FIG. 9 is a schematic cross-sectional view of the pants according to the present disclosure.
Figure 10:
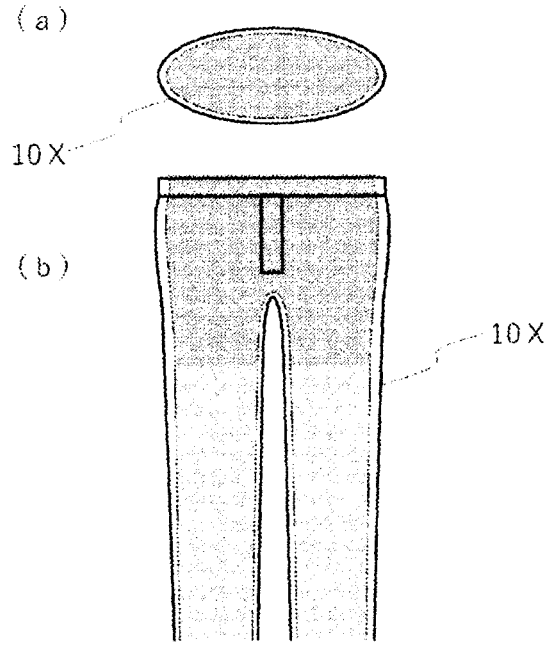
FIG. 10 is a schematic horizontal cross-sectional view (part (a)) and a schematic front view (part (b)) of the pants to be worn by a healthy person.
Figure 11:
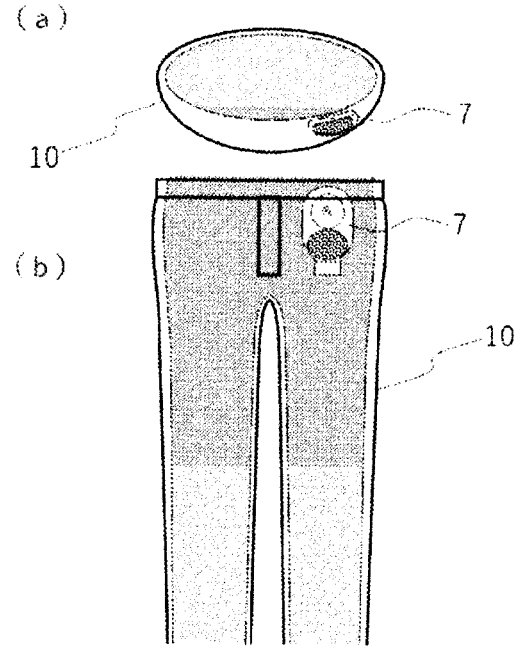
FIG. 11 is a schematic horizontal cross-sectional view (part (a)) and a schematic front view (part (b)) of the pants according to the present disclosure.

As for the above-described respective body components, like sewing of conventional pants, the inseam portion of the median line side 1*a* of the right front-body component 1 and the inseam portion of the back median line side 3*a* of the right back-body component 3, the side surface side 1*b* of the right front-body component 1 and the side surface side 3*b* of the right back-body component 3, the side surface side 2*b* of the left front-body component 2 and the side surface side 4*b* of the left back-body component 4, and, the inseam portion of the median line side 2*a* of the left front-body component 2 and the inseam portion of the back median line side 4*a* of the left back-body component 4 are sewn with each other, respectively. Moreover, the rise portion of the median line side 1*a* of the right front-body component 1 and the rise portion of the median line side 2*a* of the left front-body component, and, the rise portion of the back median line side 3*a* of the right back-body component 3 and the rise portion of the back median line side 4*a* of the left back-body component 4 are sewn with each other, respectively. Hence, the pants 10 as illustrated in FIG. 9 and FIG. 11 are formed. Note that as for the median line side 1*a* of the right front-body component 1 and for the median line side 2*a* of the left front-body component, all of or a part of those components may be formed so as to be openable and closable by a fastener, a button, etc., instead of sewing the respective rise portions with each other. The pants 10 formed in this manner is in a shape such that the portion around the waist that is the attaching portion of the stoma prosthetics 7 is large but the crotch portion and the portions around legs are slim. Moreover, since sewing similar to conventional technologies is applicable, the production is facilitated.

Figure 12:
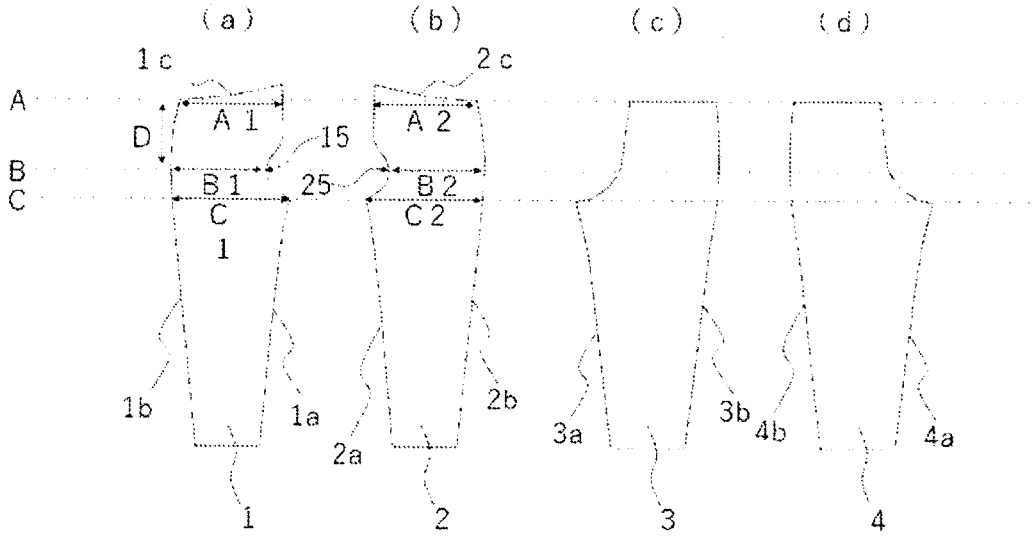
FIG. 12 is a schematic diagram of a body component of another pants according to the present disclosure.

Furthermore, since the pants 10 are formed in a shape such that the median line side 1*a* of the right front-body component 1 and the median line side 2*a* of the left front-body component are expanded, when the waist-line-A side is formed in a linear shape, the worn pants 10 is likely to have the front side descended, which deteriorates the appearance. Hence, as illustrated in FIG. 12, respective upper portions 1*c* and 2*c* of the right front-body component of the pants 10 and of the left front-body component thereof may be formed in such a way that the median line sides 1*a* and 2*a* are higher than the side surface sides 1*b* and 2*b*. More specifically, the respective upper portions 1*c* and 2*c* of the right front-body component and of the left front-body component may be formed in a linear shape or in a curved shape in such a way that the median line sides 1*a* and 2*a* are higher than the side surface sides 1*b* and 2*b* within a range that is equal to or greater than 2.0 cm and equal to or smaller than 3.0 cm.

Figure 13:
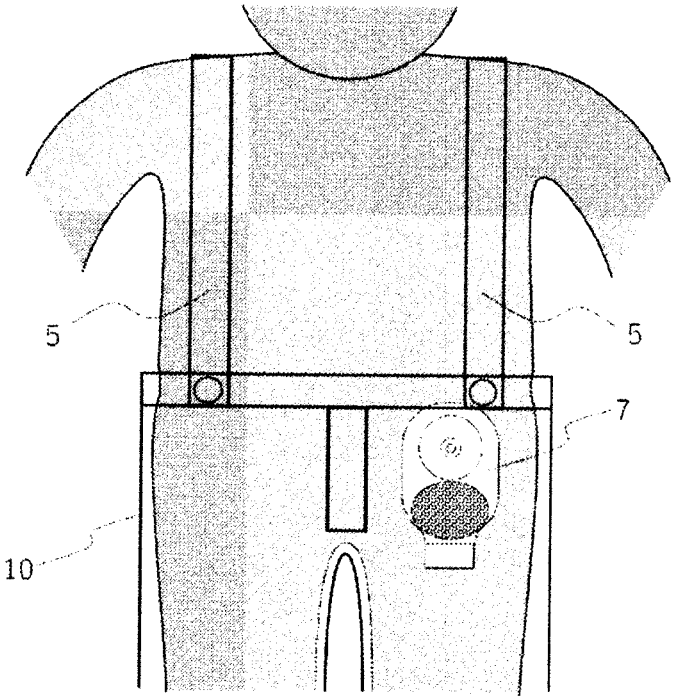
FIG. 13 is a schematic front view of the pants according to the present disclosure.

Moreover, as illustrated in FIG. 13, the pants 10 may include suspender portions 5. The suspender portions 5 are belts to suspend the pants 10 across the respective shoulders of the wearing person, and may be integrated with the pants 10, may be a type like a so-called overall, or may be attachable to and detachable from the pants 10. This prevents the pants 10 from slipping down. Moreover, since the portion where the stoma prosthetics 7 are attached is not tightened by a waist belt, etc., there is an advantageous effect such that a load to a patient is little. Note that, when the suspender portions 5 are formed so as to be attachable and detachable, a clip type or a button fastening type, and the like should generally known schemes, such as a clip scheme and a button-down scheme, may be applicable.

REFERENCE SIGNS LIST

1 Right front-body component
1X, 1Y (Conventional) right front-body component
2 Left front-body component
2X, 2Y (Conventional) left front-body component
3 Right back-body component
3X, 3Y (Conventional) right back-body component
4 Left back-body component
4X, 4Y (Conventional) left back-body component
1*a*, 2*a* Median line side
3*a*, 4*a* Back median line side
1*b*, 2*b*, 3*b*, 4*b* Side surface side
1*c*, 2*c* Upper portion
5 Suspender portion
7 Stoma prosthetics
8 Stoma
9 Excrement
10 Pants
10X, 10Y (Conventional) pants
15, 25 Concaved portion
71 Egestion opening
A Waist line
B Minimum width line
C Crotch line
A1, A2, B1, B2, C1, C2 Width
D Distance between minimum width line B and waist line A

What is claimed is:

1. Pants comprising:
a right front-body component;
a left front-body component;
a right back-body component; and
a left back-body component,
wherein when, in the right front-body component and in the left front-body component, a line which is in parallel with a waist line of the right front-body component and a waist line of the left front-body component, and which passes through a position where a rise portion has a minimum width is defined as a minimum width line;
a position of the minimum width line in a vertical direction is formed within a range that is equal to or greater than 3 cm but equal to or smaller than 27 cm from the waist line; and
a width of the waist line is formed so as to be larger than the minimum width within a range that is equal to or greater than 1 cm but equal to or smaller than 7 cm therefrom.

2. The pants according to claim 1, wherein an upper portion of the right front-body component and an upper portion of the left front-body component have respective median line sides formed so as to be higher than respective side surface sides thereof.

3. The pants according to claim 1, further comprising a suspender portion.

4. The pants according to claim 2, further comprising a suspender portion.

* * * * *